US007640871B2

(12) United States Patent
Arozena Bergaretxe

(10) Patent No.: US 7,640,871 B2
(45) Date of Patent: Jan. 5, 2010

(54) SLAB FORMWORK SYSTEM

(75) Inventor: Alberto Arozena Bergaretxe, Guipuzcoa (ES)

(73) Assignee: Ulma Cye., S. Coop., Guipuzcoa (ES)

( * ) Notice: Subject to any disclaimer, the term of this patent is extended or adjusted under 35 U.S.C. 154(b) by 1119 days.

(21) Appl. No.: 10/677,927

(22) Filed: Oct. 2, 2003

(65) Prior Publication Data

US 2004/0075043 A1 Apr. 22, 2004

Related U.S. Application Data

(63) Continuation of application No. PCT/ES01/00133, filed on Apr. 3, 2001.

(51) Int. Cl.
*A47B 13/02* (2006.01)
*E04G 11/38* (2006.01)

(52) U.S. Cl. ..... 108/150; 108/155; 108/156; 108/157.17; 249/18

(58) Field of Classification Search ..... 249/18, 249/24, 26, 28; 108/56.3
See application file for complete search history.

(56) References Cited

U.S. PATENT DOCUMENTS 5,614,122 A 3/1997 Schworer

FOREIGN PATENT DOCUMENTS

| | | | | |
|---|---|---|---|---|
| DE | 2927116 | * | 1/1981 | 249/18 |
| DE | 3024580 | * | 1/1982 | 249/18 |
| DE | 3147081 | * | 12/1982 | 249/18 |
| DE | 3316557 | | 10/1984 | |
| DE | 3921064 | * | 1/1991 | 249/18 |
| DE | 4237516 | * | 5/1994 | 249/18 |
| EP | 0380149 | | 8/1990 | |
| EP | 0511921 | * | 11/1992 | 249/18 |
| EP | 0718453 | | 6/1996 | |
| FR | 2473099 | | 8/1981 | |
| GB | 905408 | * | 9/1962 | 249/18 |
| GB | 905409 | * | 9/1962 | 249/18 |
| GB | 905410 | * | 9/1962 | 249/18 |
| GB | 1457136 | * | 12/1976 | 249/18 |
| GB | 2005332 | | 4/1979 | |
| GB | 2266114 | * | 1/1982 | 249/18 |
| GB | 2100331 | | 12/1982 | |

* cited by examiner

*Primary Examiner*—Michael Safavi
(74) *Attorney, Agent, or Firm*—Katten Muchin Rosenman LLP

(57) ABSTRACT

The system used to form slabs on large surfaces includes a grid structure comprised of vertical braces, support bolsters, primary beams and cross beams, all of which rest on the bolsters, with the cross beams closing the grid and providing a stiffness to the structure that allows assembly of the entire grid structure and the later positioning of the formwork panels. The bolsters provide support so that the beams can descend to a stripping position allowing to recover, before the concrete sets, both the beams and the panels. The longitudinal beams are provided with supports for the panels, constructed such that they allow the panels to hang vertically during the stripping operation. The cross beams end at a profile made of rubber or the like providing a means for sealing the grid, as well as for absorbing any possible clearances originated during the assembly of the panels.

18 Claims, 14 Drawing Sheets

SLAB FORMWORK SYSTEM

CROSS REFERENCE TO RELATED APPLICATIONS

This is a continuation of pending PCT Application PCT/ES01/00133 filed Apr. 3, 2001.

FIELD OF THE INVENTION

The present invention relates to a slab formwork system that includes: vertical braces, support bolsters mounted on the upper area of the braces, formwork panels and primary beams bearing on the bolsters; with the beams determining the support for the formwork panels, all relying on a grid structure assembly in which participate, in addition to the primary beams, crossbeams that close the grids.

The object of the invention is to provide the construction sector with a new slab formwork system with a grid structure assembly having a number of characteristics that allow assembling the structure more quickly and rationally, as well as stripping and recovery of most of the components (longitudinal or primary beams, panels and even cross beams) before the concrete is fully set.

BACKGROUND OF THE INVENTION

As is well known, slab formwork systems are systems meant for formworks of large horizontal surfaces where a high performance and high surface finish are required. They consist basically of a structure comprised of vertical braces, support bolsters provided on the upper end of the braces, and longitudinal beams mounted on the support bolsters, occasionally including cross beams, and completed by the wooden boards that define the formwork skin placed over the longitudinal or primary beams. Currently, wooden boards are often replaced with formwork panels comprised of a frame and a number of internal reinforcement partitions that support the formwork surface or skin, said formwork panels defining modular elements that simply rest on the beams without requiring nailing.

Support bolsters are meant to allow recovering part of the formwork before the concrete sets fully, allowing to reuse the materials recovered for following formworks.

Said support bolsters are generally comprised of a support surface that is in contact with the concrete and support and coupling means for the beams, with the latter means vertically moveable and capable of assuming two positions, an upper working position and a lower stripping position, such that in order to pass from one position to the other the bolsters are provided with the corresponding locking and release systems that allow the bolster to slide with respect of the brace to pass from the upper to the lower position; thus, in the latter position the beams and formwork panels also descend, allowing them to be recovered and reused for the following formwork.

Likewise, currently being used are formwork systems known as "grids" characterised in that the formwork panels are always in a given position on the beams, that is, the panels do not rest astride two consecutive beams, as is the case in "row" formworks, but instead have end panels reaching the end of the beam, that is, exactly as far as the following braces. These grid formwork systems are further complemented by flashing profiles placed transversally to close any spaces left between panels supported by a pair of longitudinal or primary beams and those of the following grid. In the stripping operation the longitudinal or primary beams and the panels are removed, and the braces and flashing profiles are left in place as these are generally between the concrete and the braces themselves.

In this sense, examples of slab formwork systems with support bolsters are those corresponding to British Patent 2,005,332 by Rapid Metal Developments Limited; German Patent 3316557 and German Utility Model G9005901 by Noe Schaltechnik GmbH.; Spanish Patent 440,081 by SGB GROUP LIMITED; European Patent 0718453 and French Patent 2,475,099 by Peri GmbH.

The slab formwork systems with support bolsters described in the aforementioned documents have drawbacks such as a slow and complex assembly of the formwork, as a beam is first mounted on its two corresponding braces and then the other beam of the grid is mounted also on its two corresponding braces, placed parallel to the first, calculating the separation between the two beams in an approximate manner to then place between them the various formwork panels that will finally determine the exact separation between the beams. This means that assembling the panels implies a readjustment of the positions of the beams and braces, which generally requires at least two workers, one placing the panels and the other moving the braces and beams as necessary, or instead assembling the beam and brace structure with a great precision of measurements and positions.

In any event, the structure consisting only of beams and braces is not sufficiently rigid, so that it is best to simultaneously assemble the beams that form the grid and the braces, thereby requiring more than one worker and a greater assembly time as the person assembling the panels must wait until the braces and beams have been raised, which generally requires more time. In addition, and especially when the formwork is at a great height, the panels are mounted from the top and the braces and beams from the floor, so that it would be very difficult for a single worker to assemble the entire formwork, as this would require constantly travelling up and down.

SUMMARY OF THE INVENTION

The system disclosed has been conceived to solve satisfactorily the drawbacks and problems described above by means of simple yet effective solutions, based on the grid formwork system mainly consisting of vertical braces, support bolsters mounted above these, longitudinal or primary beams resting on their ends on the bolsters and formwork panels resting on said beams.

More specifically, one of the novel characteristics of the formwork system of the invention is that mounted on the support bolsters in addition to the traditional primary beams are cross beams that close the grid, so that said cross beams provide an exact measure of the separation of the primary beams, as well as stiffening the structure even before the formwork panels are placed allowing to first assemble the grid and then place the panels. In this way the pace of the assembly is quickened, particularly when the formwork is at a great height above the ground and the panels are mounted from above. It also allows reducing the number of workers required for the assembly, as the same person who initially places the braces and beams from the ground can then quickly place the panels from above. This is, the assembly is more systematic.

The aforementioned cross beams are complemented with additional parts of an elastic material, preferably rubber bars, that cover the entire upper surface and sides of said beams and which are inserted in a number of longitudinal grooves provided for such purpose in the beams, so that said upper and lateral coating in addition to providing a seal between grid squares keeps the material (aluminium) which the beams are made of from touching the concrete. It also allows a degree of lateral clearance between the panels of adjacent grid squares during assembly of the panels, as the rubber bars push the panels against each other, thus closing any gaps.

Said cross beams are recovered during stripping, as are the primary beams and the panels, so that the formwork is supported only by the bolsters and braces.

In addition to the above described cross beams, in certain cases where it is necessary to adapt to specific circumstances, such as in formwork placed against columns or pillars, that is, when a column or pillar is placed between the primary beam and the cross beam, secondary beams are used that are mounted on the primary beams perpendicularly, with boards nailed on them that act as a formwork skin and finish this particular area of the formwork. For this purpose both the primary beams and the secondary beams can optionally have a wooden block on their upper end to allow nailing traditional wood boards on them.

Another novel characteristic of the system relates to the support bolsters, which have a plate with four cross-shaped sectors defining as many cradles for the longitudinal and cross beams to rest in, and said cradles having a base that is inclined downwards towards the middle to achieve a slight wedging of the beams against the braces, so that by means of this inclined-base support and the weight of the concrete the panels will tend to close the grid, thereby improving the seal of the system.

For this purpose the longitudinal and cross beams have a protrusion on their ends in the form of a heel, with its lower surface inclined and complementary of the inclination of the base of the support cradles defined in the brace plates in order to determine an effective support between the two components and, as mentioned before, tending to close the grid to improve the seal.

Said primary beams have lateral longitudinal grooves with a slightly inclined base, similar to that of the cradles in the support bolster plates, for support and assembly of the formwork panel, or in special cases of the secondary beams. For this purpose the bottom of the formwork panel frame has an inclined plane similar to that of the longitudinal grooves of the primary beams, so that support is established by these inclined planes, making the panels tend to approach each other and thus preventing any small separations from existing between them that could result in concrete dripping between the joints.

Returning to the support bolsters, it should also be mentioned that the cradles for positioning and support provided in the plate are laterally limited by corresponding partitions, which in addition to acting as stiffening and reinforcement means act as guides to simplify the assembly of the beams on the bolsters, while on the front they end in protrusions that allow hanging the primary beams from the bolsters to thereby simplify the raising of the beams and the assembly of the formwork.

In addition, the plate is mounted on the main tube of the bolster so that it can slide upwards and downwards, in order to occupy the upper operative position and the lower or stripping position respectively. The upper position is maintained by a type of nut acting as a wedge that can be locked and released by turning in one sense or the other, for which it is internally provided with a pair of inclined planes that wedge against a stop element provided on the main bolster tube. Said nut acting as a wedge is provided with rectangular lateral protrusions that can be struck with a hammer to release it.

Furthermore, the bolsters are inferiorly provided with a tubular segment by which the top end of the brace is coupled, being secured by a swivelling bolt fastener established inside the lower tubular segment.

A further novel characteristic of the system relates to the formwork panels, which being of the type formed by a peripheral frame with a number of transverse partitions, has the special characteristic of including corner reinforcements determined by L-shaped brackets to prevent possible breaks due to impacts in said areas, which reinforcements also insure a perfect shape of the corners. A further novel characteristic is the fact that the transverse partitions of the frame that makes up the formwork panel are transversally joined in pairs by means of further partitions or ribs that increase the sturdiness of the assembly. Also a novelty are internal reinforcements at the corners that not only reinforce the aforementioned brackets but can also be used for support and guidance in other formwork systems.

Yet another special characteristic of the frame is an inclined lower edge in the shape of a wedge in order to guide and facilitate the introduction of the last panel of each grid square.

It should also be said that the aforementioned panels are provided with a lower bevelling that allows the panels to hang vertically from the beams during stripping, thereby simplifying their removal and thus the stripping of the panels. For this purpose, the longitudinal grooves of the primary beams have a front protrusion from which hangs the panel during the stripping operation.

The above described structure for the primary beams allows a transverse assembly on the grooves established on their side of further longitudinal beams to provide a protrusion at a 90° angle that changes the direction of assembly of the grid or allows overhangs to be established, with the support determined on said grooves by the protrusions provided on the end of the longitudinal beams set at 90°.

Finally, the primary beams are provided with lower protrusions in the form of heels, between which is defined a recess that forms a housing, with said heels having an inclined surface so that the aforementioned primary beams can rest by said inclined surfaces on fixed bolsters, with the recess being used to house means or elements for centering the beam on the bolster.

BRIEF DESCRIPTION OF THE DRAWINGS

As a complement of the description being made and in order to aid a better understanding of the characteristics of the invention, according to an example of a preferred embodiment, a set of drawings is accompanied as an integral part of the description where for purposes of illustration and in a non-limiting sense the following is shown.

PREFERRED EMBODIMENT OF THE INVENTION

Figure 1:
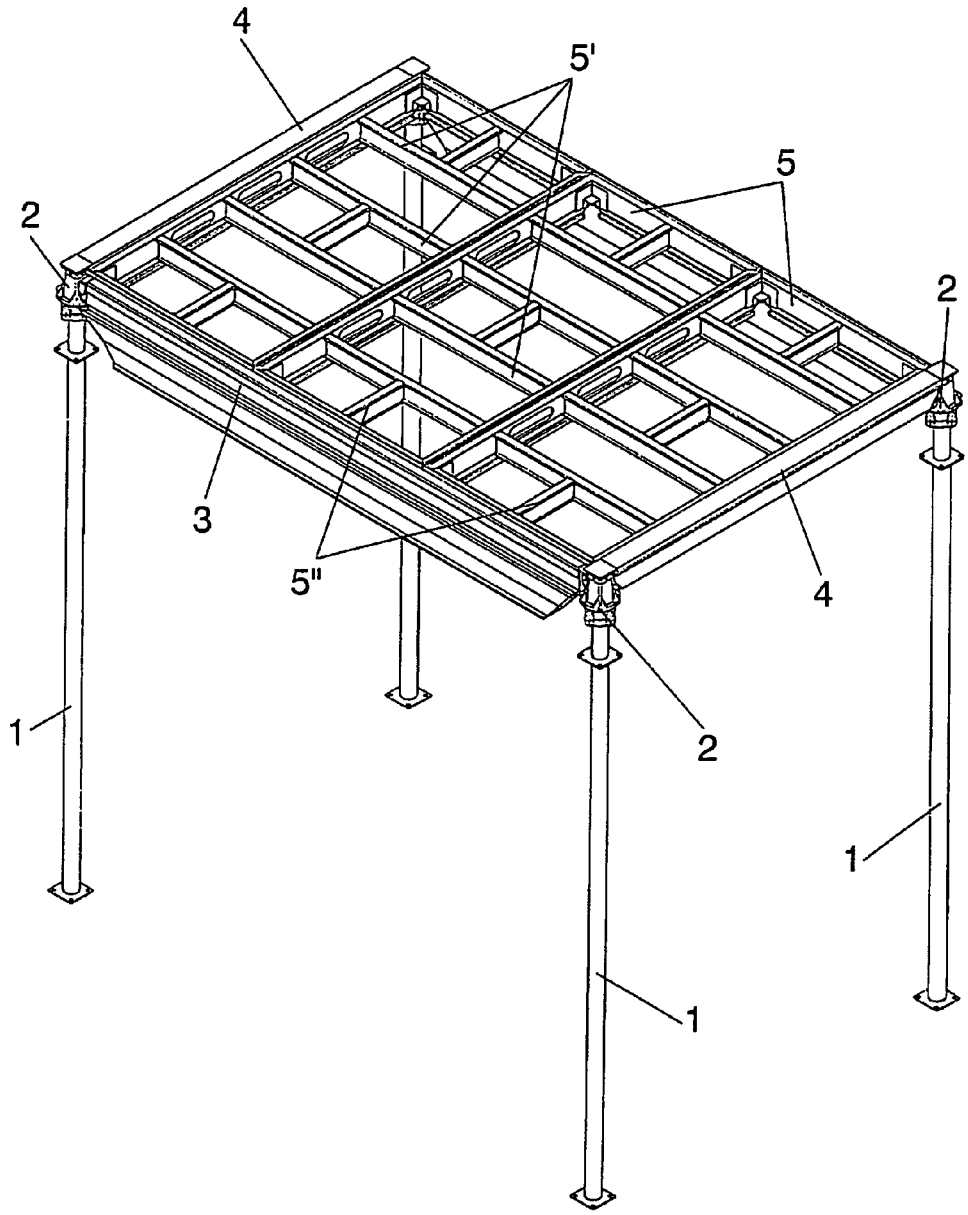
FIG. 1 shows a general perspective view of a full formwork grid square constructed according to the object of the invention.

As shown in the above-described figures, the grid formwork system object of the invention is comprised of braces (1), support bolsters (2), a pair of longitudinal or primary beams (3) and a pair of cross beams (4) that, as the primary beams (3), rest on the bolsters (2), with said cross beams (4) closing the grid square, and being complemented by the formwork panels (5) that rest on the primary beams (3). The cross beams (4) close the grid square so that in addition to providing the exact measure between the primary beams (3) they stiffen the structure during the assembly, determining a grid that is sufficiently stiff even before placing the formwork panels (5), which allows first assembling the entire grid structure consisting of beams and braces and then placing the formwork panels (5).

Said primary beams (3) are provided on their ends with protrusions having an inferior projection in the form of a heel (6), with its inner surface (7) slightly inclined for reasons that will be explained further below. At an intermediate height they are provided with grooves (8) having a base that is inclined towards the centre, which grooves (8) are externally accompanied by a projection (9), while on the top the primary beam (3) can be optionally provided with a wooden block (10) that will support the board used for riveting to both the wall and pillars, as the wooden block (10) allows securing the board with nails. On the bottom it is provided with projections (11), the purpose of which will be explained further below.

In addition, the cross beams (4) are also provided on their bottom with projections in the form of heels (6) and with an inclined bottom surface (7), similar to the heels (6) of the bottom surface of the primary beams (3) and labelled with the same number, as these heels will determine the support points for the beams on the support bolsters (2).

Figure 9:
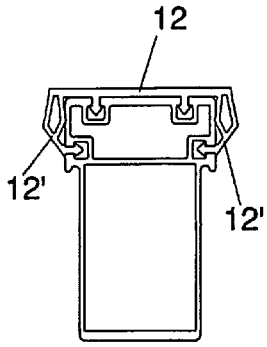
Figure 10:
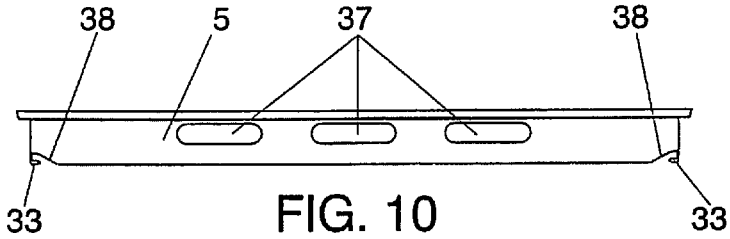
FIGS. 10 and 11 show respectively an elevation and profile view of a formwork panel.

Said cross beams (4) are provided on top with an additional part consisting of a rubber bar (12) with lateral extensions (12') that are completely flexible, as is clearly shown in FIG. 9, so that said cross beams (4) in addition to determining closing means of the grid squares define a sealing means with the rubber bar (12) that covers said cross beam (4) on its top and sides.

On their part, the support bolsters (2) consist of a main tube (13) that ends on its top surface with a flat surface (14) that rests against the concrete, with a plate (16) mounted between said upper support stopping element (14) and a plate (15), that rests on a clamp or nut that acts as a locking wedge (17), with these two parts able to slide up and down on the main tube (13) of the bolster, so that in its upper position the bolster is in an operative situation and in the lower position of the plate (16) the bolster is in the stripping position, as will be described below.

The plate (16) has four sectors (18), forming a cross shape, defining as many resting cradles for the primary beams (3) and the cross beams (4), with said cradles (18) having a base or bottom that is complementary of the inclined lower surfaces (7) of the support heels (6) of the primary beams (3) and the secondary beams (4).

The support bolsters (2) are provided with a plate (16) having four sectors, forming a cross shape, that define as many cradles (18) with inclined bases for the positioning and support of the ends of the primary beams (3) and the cross beams (4), wherein each sector defines a cradle.

The cradles (18) of the plate (16) are laterally limited by corresponding partitions (20) that in addition to reinforcing the plate (16) define a guide means for positioning and support of the heels (6) of the primary and secondary beams (3) and (4), as well as by front protrusions (19) that allow hanging the primary beams (3) from the plates (16), thereby facilitating the raising of the beams during the formwork assembly operations.

The beam rests on the plate such that, with the exception of the clearances required for assembly, it prevents movement in either sense of the beams, so that the grid obtained in each case is exactly as required for mounting the panels (5) in it.

As regards the clamp or nut (17) acting as a locking wedge, it is internally provided with a pair of inclined plates (21) that act as a wedge on a stopping element (22) provided for such purpose in the main tube (13) of the bolster assembly, such that it is released or locked by turning or striking it with a hammer. Said clamp or locking wedge (17) is provided on its side with projections (23) where the hammer is struck to release it. Said locking wedge (17) works by rotating about its support or main tube (13) of the bolster, thereby obtaining a more compact assembly and preventing any interference during stripping, even when operating with systems very near to already raised walls.

The bolster being described, and more specifically its main tube (13), is provided with elements (24) by way of a guide for the plate (16) as it moves up or down, preventing the latter from turning with respect to the main tube (13).

The bolster described is mounted on the corresponding brace (1) by a lower tubular segment (25) in which is mounted a connection element (26) having two protrusions (27) and (28) meant to be inserted in an orifice made in the upper part of the corresponding brace (1) and be housed in an orifice of the main tube (13) of the bolster, with said bolt (26) pushed towards a locked position by a spring (29) in order to maintain the assembly of the bolster on the brace, so that if the bolster must be released it is sufficient to press on the protrusion (28) that determines a button against the action of the spring (29), making the bolt (26) move inwards.

This inwards motion of the bolt (26) naturally releases the bolster (2) from the corresponding brace (1).

Figure 11:
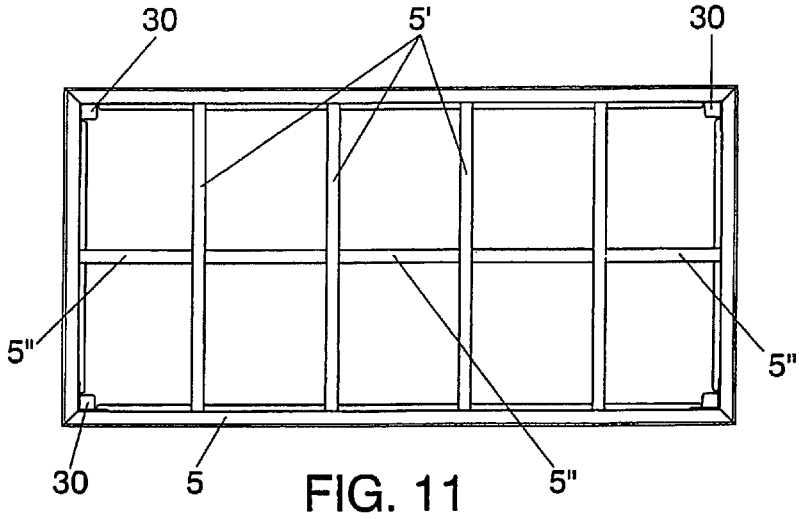
Figure 12A:
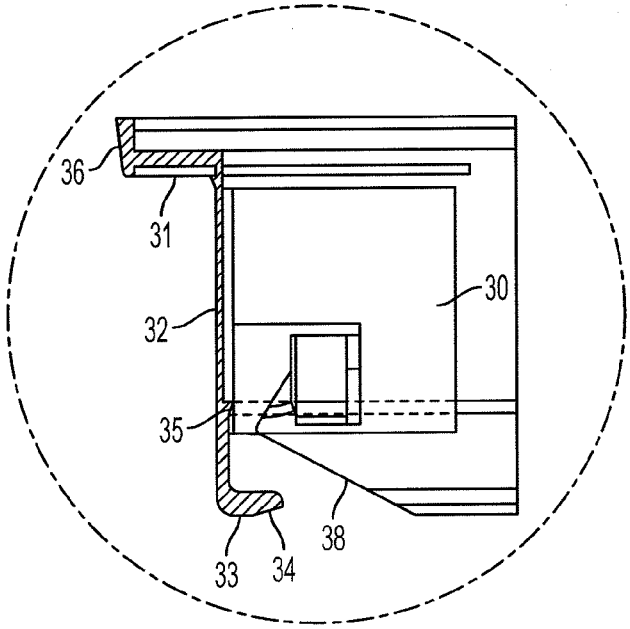
FIGS. 12*a* and 12*b* show enlarged detail views of the corner reinforcements provided in the formwork panel.
Figure 12B:
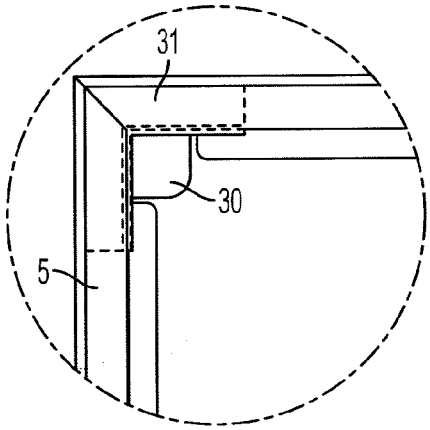
Figure 13A:
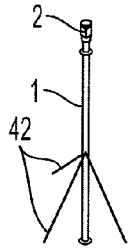
FIGS. 13*a*, 13*b*, 13*c*, 13*d*, 13*e*, 13*f*, and 13*g* show various phases of the assembly sequence for a formwork grid square.
Figure 13B:
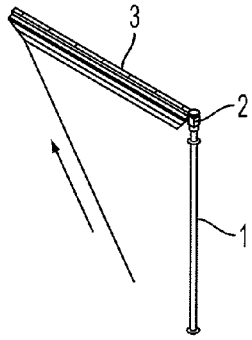
Figure 13C:
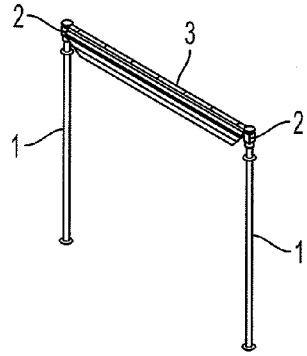
Figure 13D:
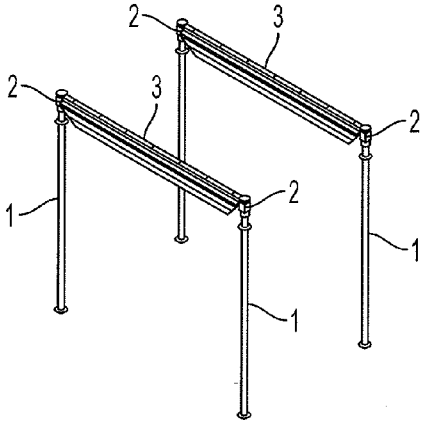
Figure 13E:
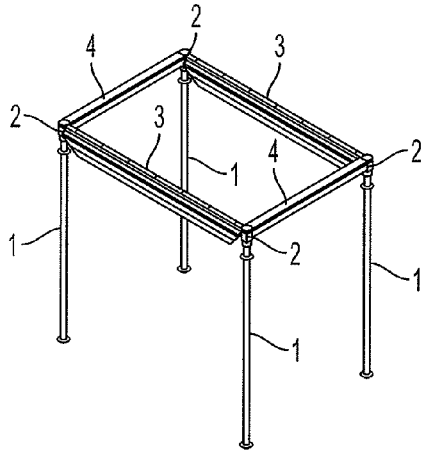
Figure 13F:
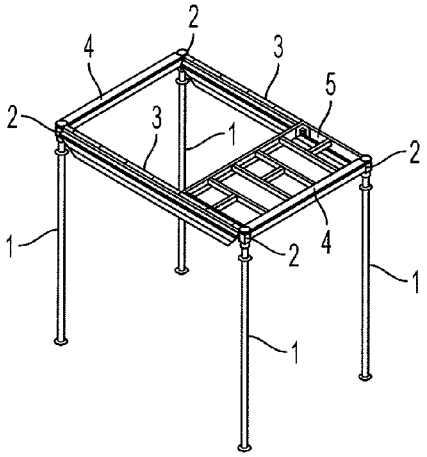
Figure 13G:
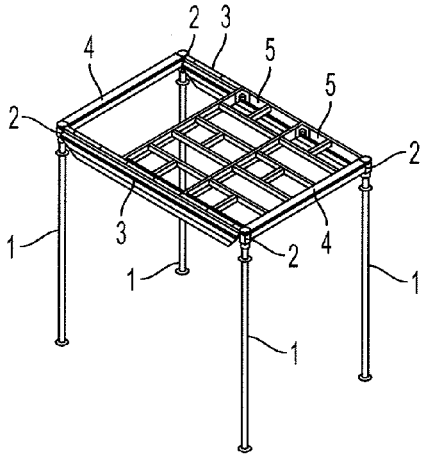
Figure 14:
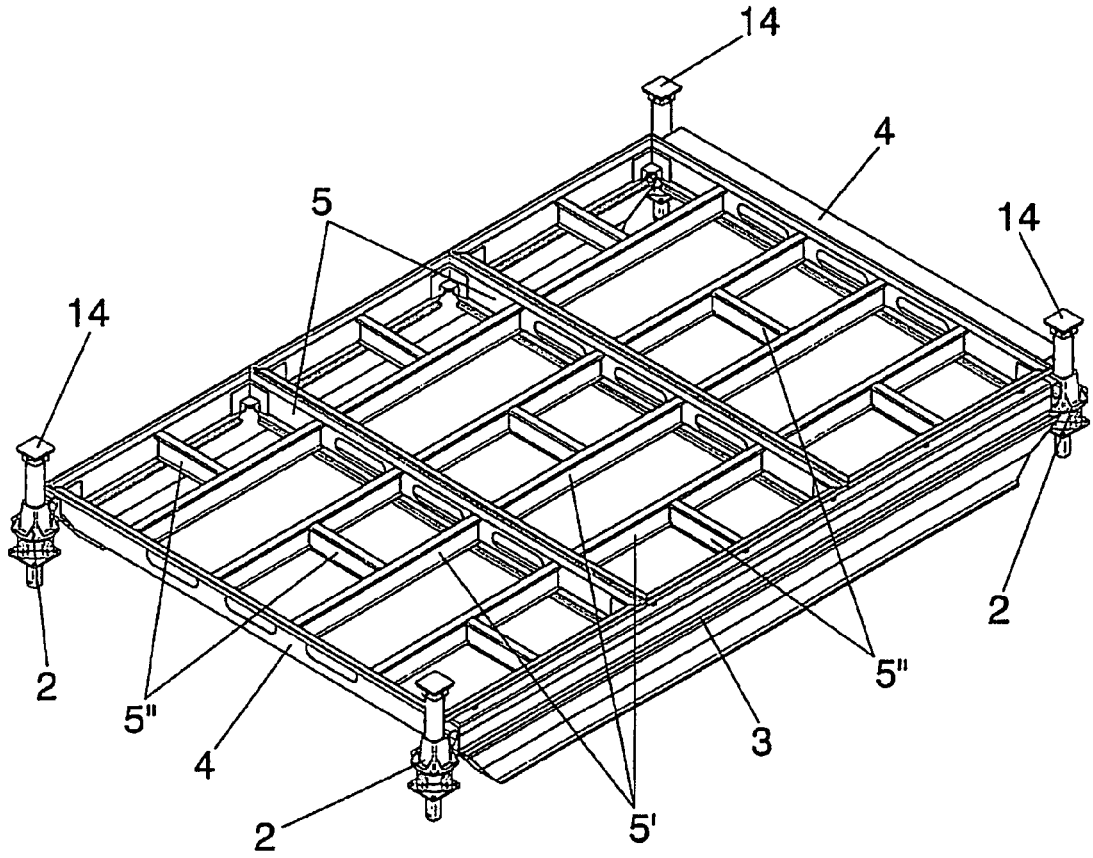
FIGS. 14 and 15 show corresponding views of two stripping stages, one with the system in the lowermost position of the support bolster and the other with the panels hanging vertically from the beams.
Figure 15:
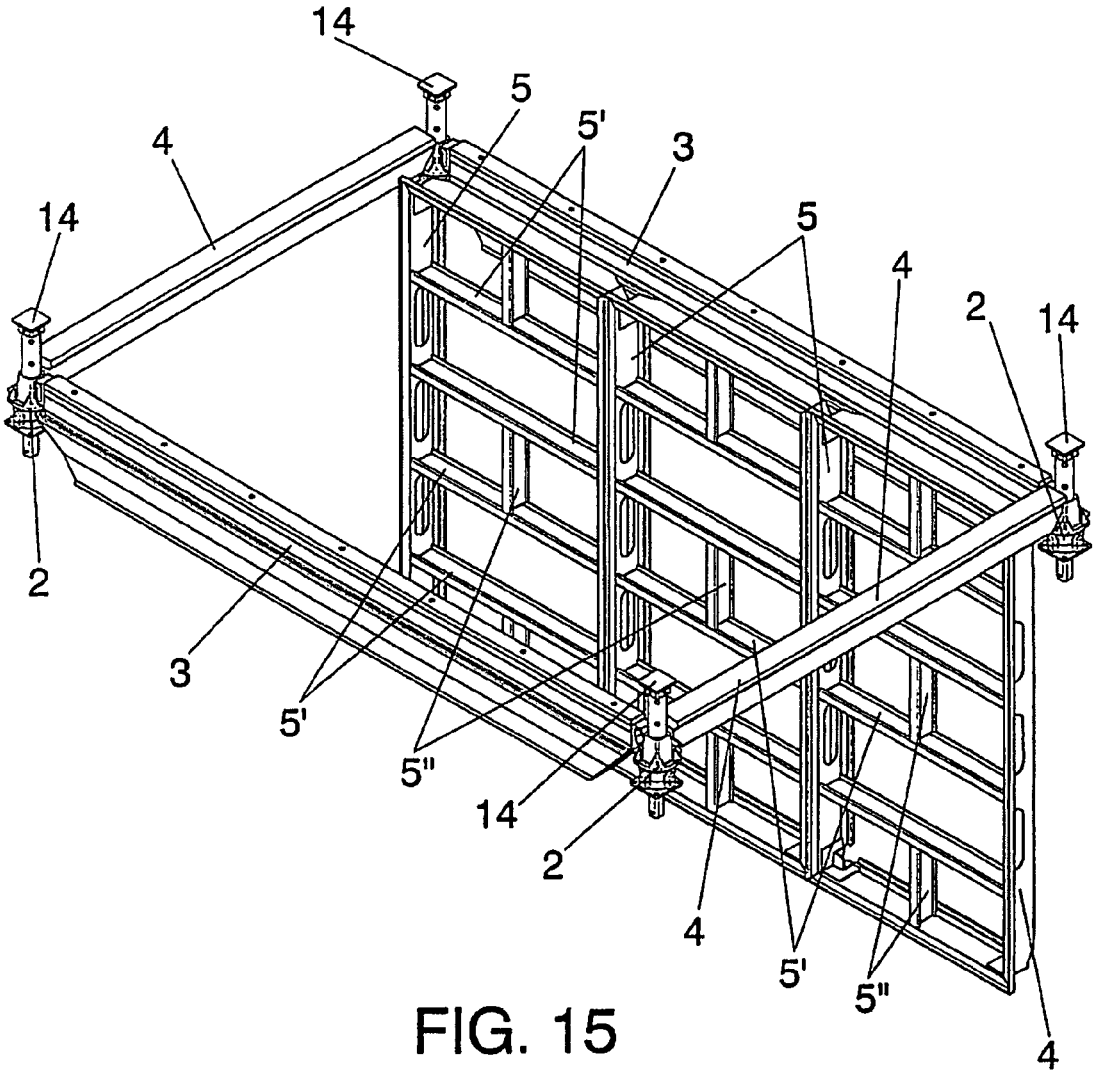

As regards the formwork panels (5), they consist of an aluminium frame made of extruded profiles and a grid-like construction made of partitions (5') that are stiffened to each other by pairs by means of partitions (5") perpendicular to the partitions (5'), as clearly shown in FIG. 11, with said partitions (5") giving the panel (5) assembly a greater stiffness. The aforementioned frame is provided at its corners with an internal reinforcement (30) that can act as a support for panels used in other formwork systems, as well as reinforcing brackets (31) that are mounted by guides on the extruded profile (32) of the frame, as shown in FIG. 12, with the brackets (31) ensuring a perfect shape of the frame corners and reinforcing them to prevent breaks at these areas due to impacts.

Figure 16:
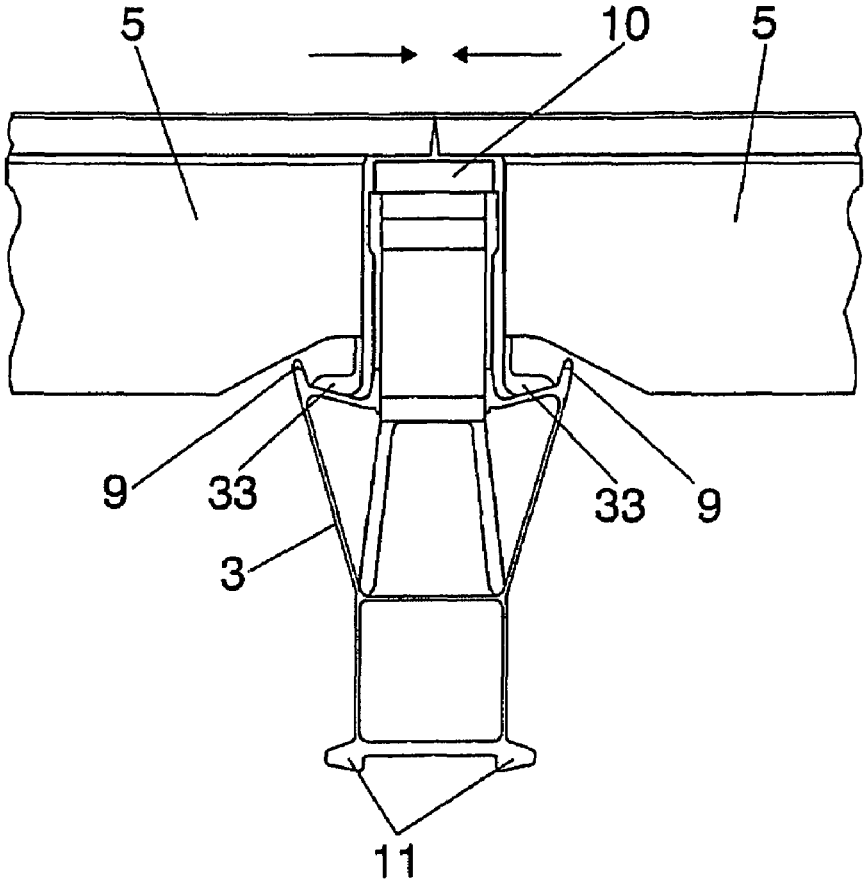
FIG. 16 shows a side view of the assembly of the formwork panels on the primary beam.
Figure 17:
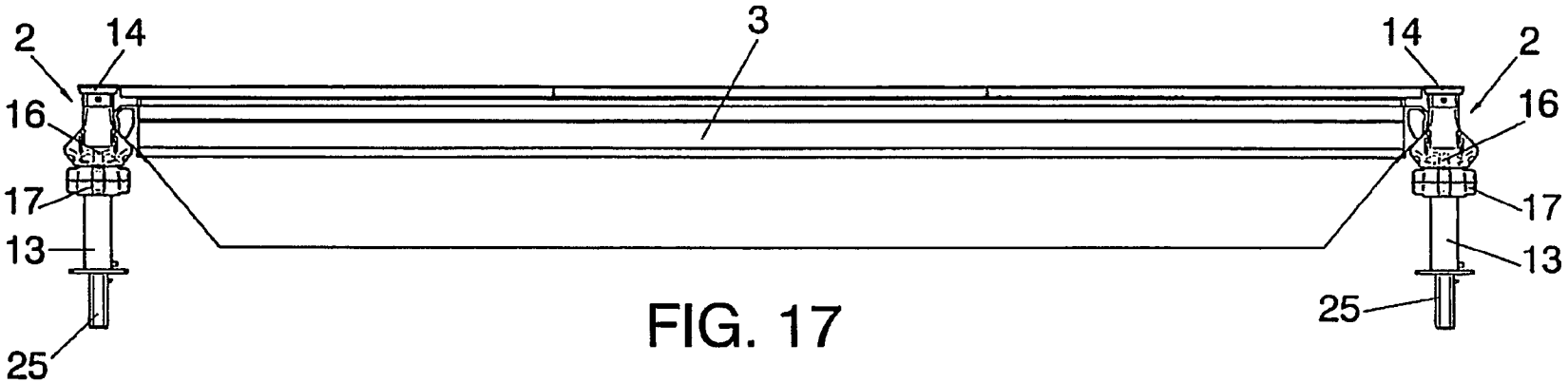
FIGS. 17 and 18 show respective side elevation views of a primary beam mounted on two support bolsters, the first corresponding to a working position and the second to a stripping position.
Figure 18:
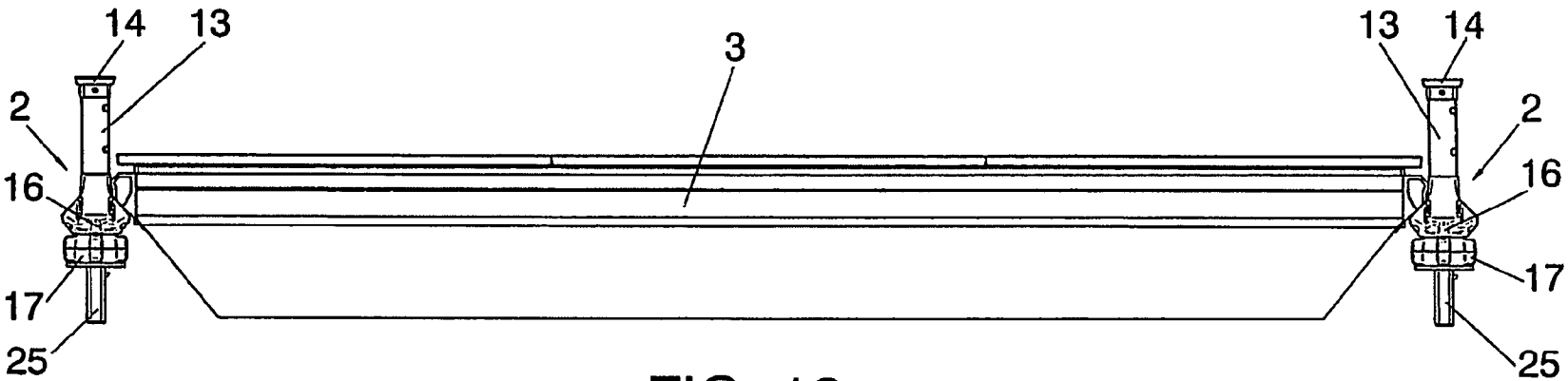
Figure 19:
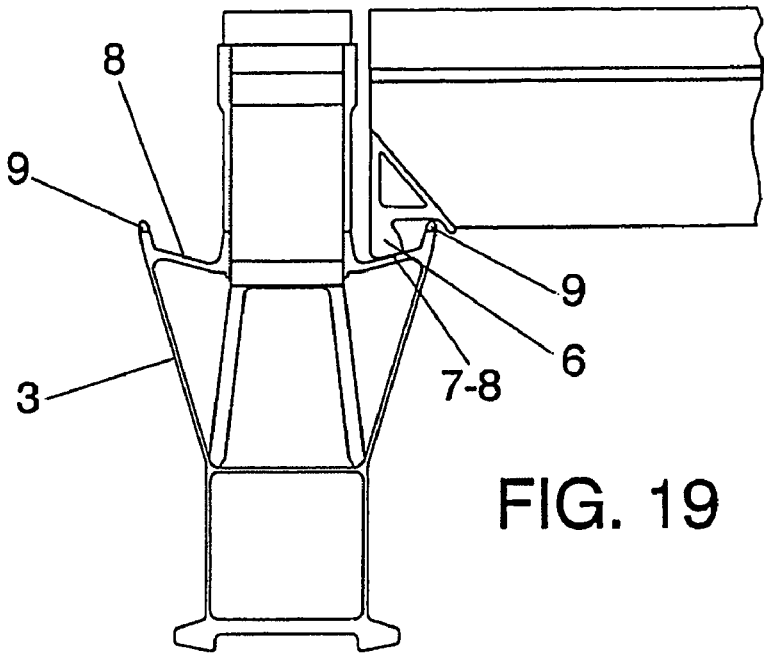
FIG. 19 shows a side view of a secondary beam mounted on a primary beam.

The frame corresponding to the panel (5) is supported by the sides of the primary beams (3), specifically on the grooves (8) with inclined bases of said primary beams (3). For this purpose the bottom of the profile (32) corresponding to the frame of the panel (5) is provided with a heel (33) with an inclined surface (34) that matches the heels (6) and inclined lower surface (7) of the primary and cross beams, resting with said lower heel (33) and its inclined surface (34) on the aforementioned grooves (8) of the primary beams (3), as shown clearly in FIG. 16; this inclined support allows a maximum approach of the panels (5) towards the geometrical axis of the primary beams (3), ensuring that the panel (5) resting on one of the sides of the beam (3) and the one resting on the other side will tend to approach each other, thus preventing any small separations causing concrete dripping at these unions.

The profile (32) of the frame of the panel (5) is provided at an intermediate height with a small protrusion (35) that is used to support the partitions of the panel, providing a flat and controlled surface during the construction process for the formwork board or surface, while on its top the profile (32) is provided with a projection with an outer inclined surface (36) that determines a type of wedge facilitating the insertion of the last panel (5) in the already formed grid, also having means to establish anti-drip elements in the event that, for any reason, the concrete slides out through the union. The frame of the panel (5) is provided with a plurality of orifices (37) on its longitudinal sides allowing to lighten the panel as a whole and further providing grips for carrying it.

Figure 20:
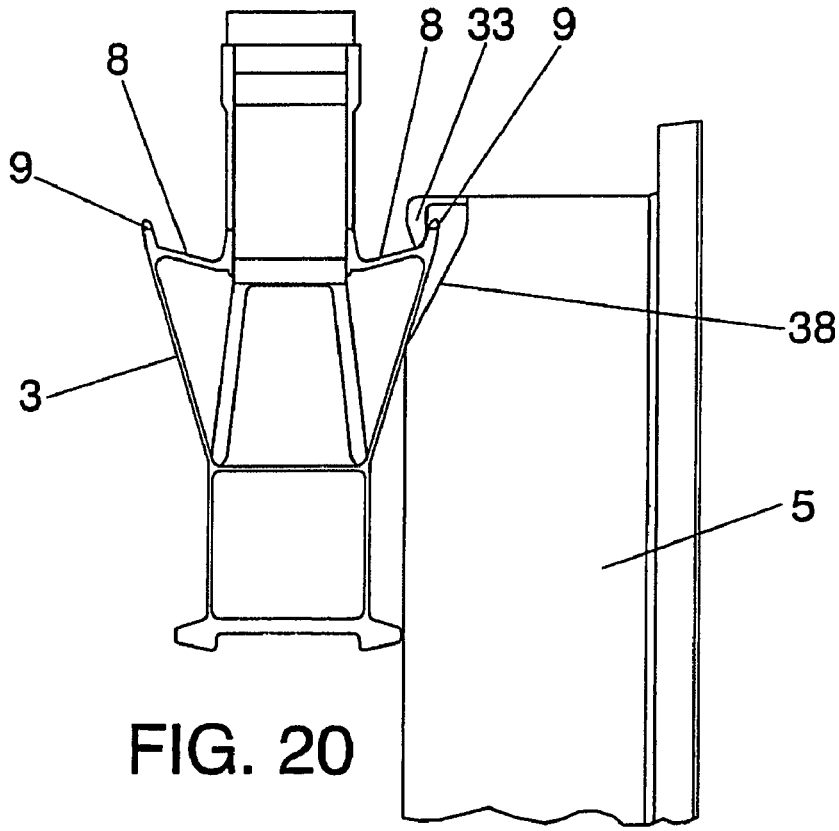
FIG. 20 shows a side view of the manner in which the formwork panels hang from the primary beam.
Figure 21:
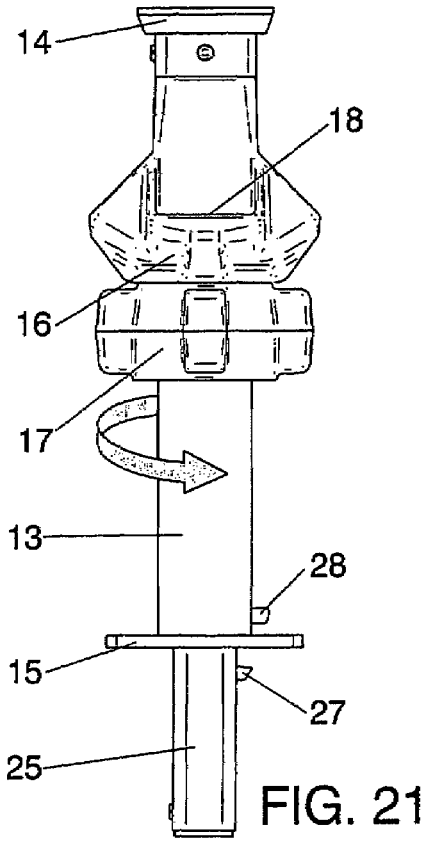
FIGS. 21 and 22 show corresponding views of the bolster in the two positions it may adopt, one corresponding to the working position and the other to the stripping position.
Figure 22:
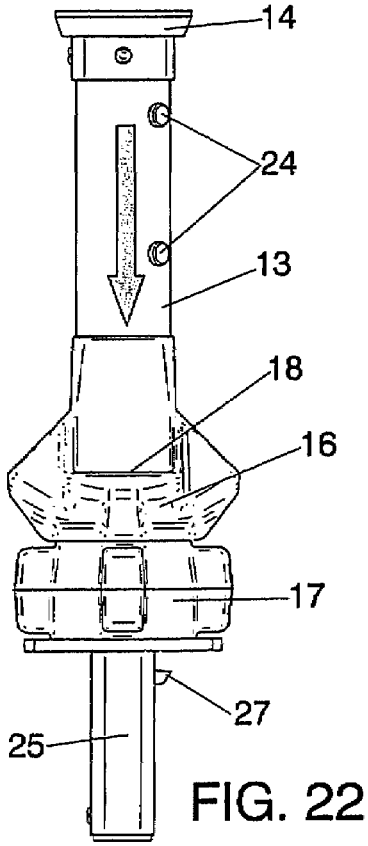
Figure 23:
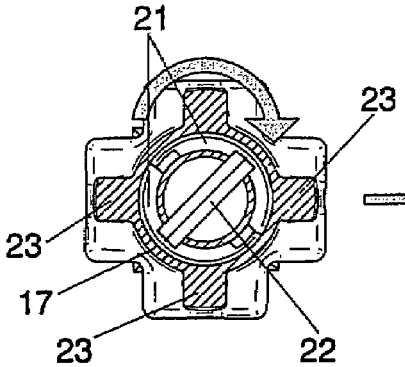
FIGS. 23 and 24 show corresponding sectional views along a horizontal plane of the bolsters of the two previous figures, showing the locking of the clamp acting as a wedge and its release, respectively.
Figure 24:
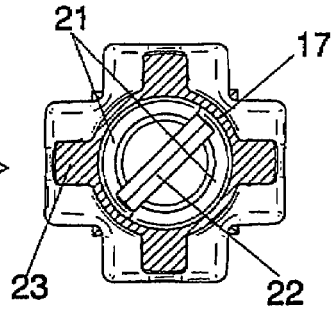

Finally, said panels (5) have a bevelling (38) allowing that during the stripping operation the panels (5) can hang vertically from the corresponding primary beam (3), as shown in FIG. 20.

Figure 2:
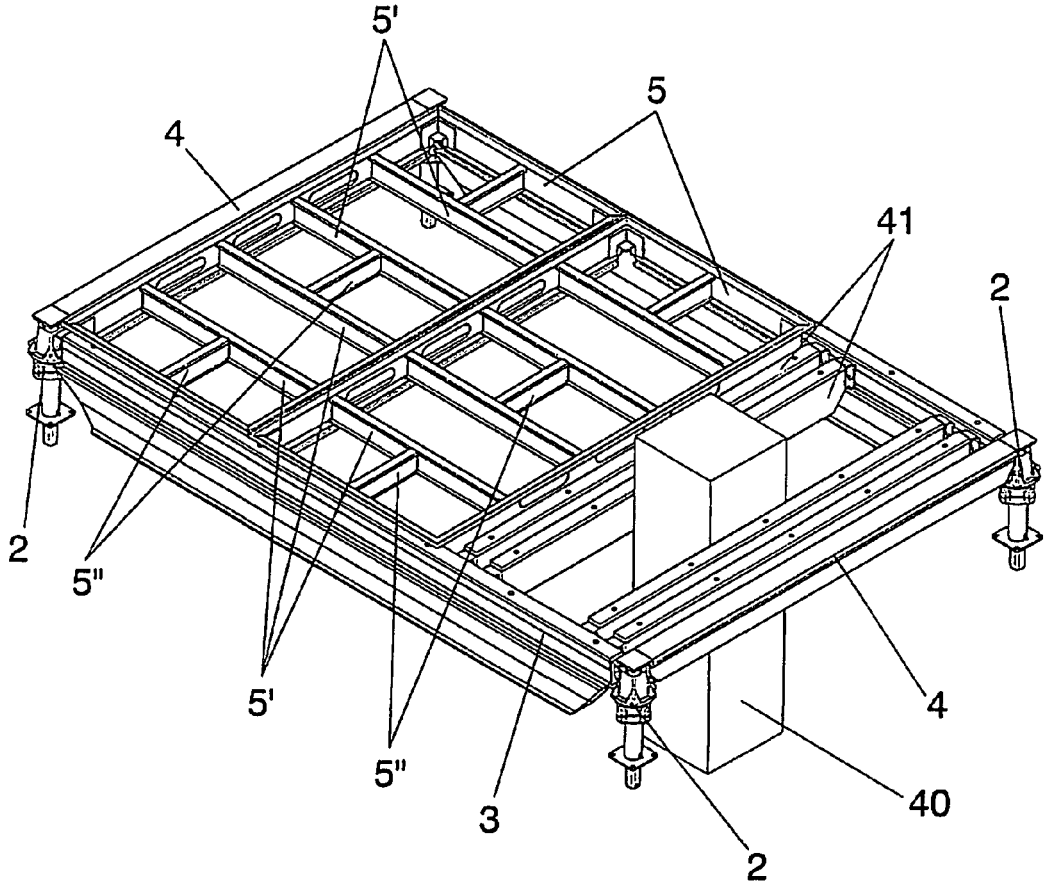
FIG. 2 shows another perspective view of the assembly of a grid square which includes a column, showing the arrangement of the secondary beams.

In cases where riveting to columns or walls is performed, as shown in FIG. 2, where a grid is shown having a column (40) inside it between longitudinal beams (3) and cross beams (4), secondary beams (41) are used placed also transversally between the primary beams (3); boards that form the formwork skin are nailed on these secondary beams (41).

Figure 3:
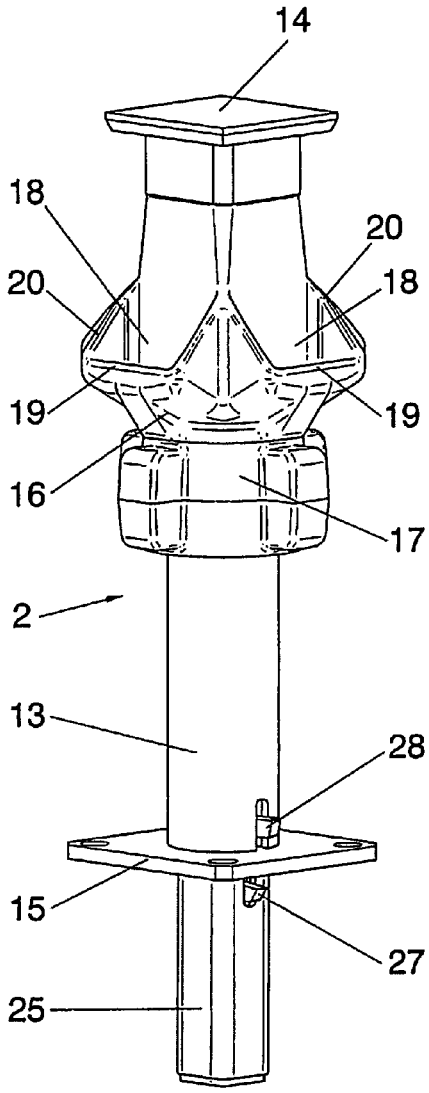
FIGS. 3 and 4 show, respectively, a perspective view and a vertical section view of the support bolster.
Figure 4:
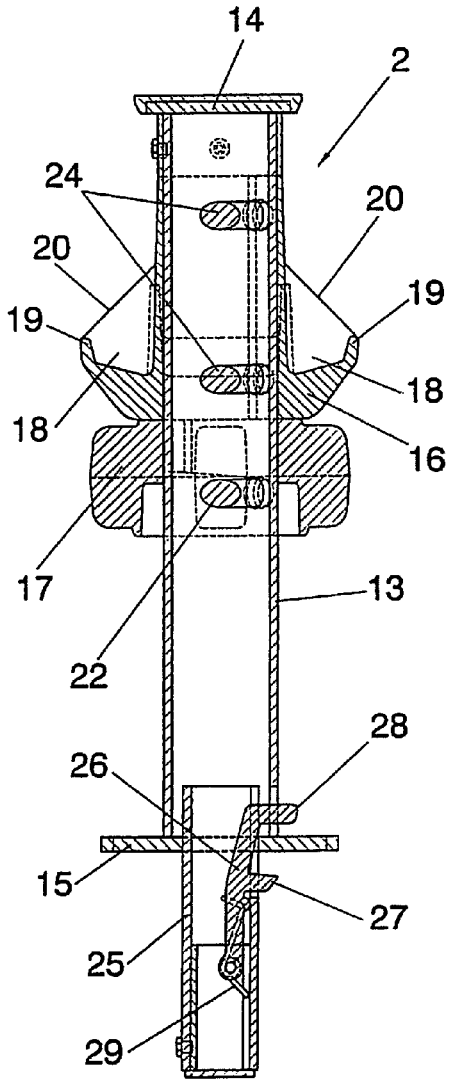
Figure 5:
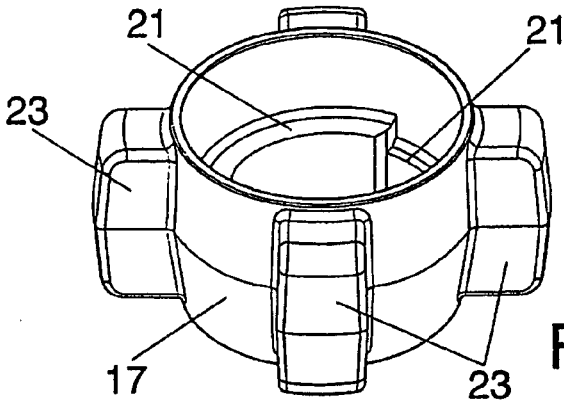
FIG. 5 shows a perspective view of the clamp or locking wedge that is part of the bolster object of the invention.
Figure 6:
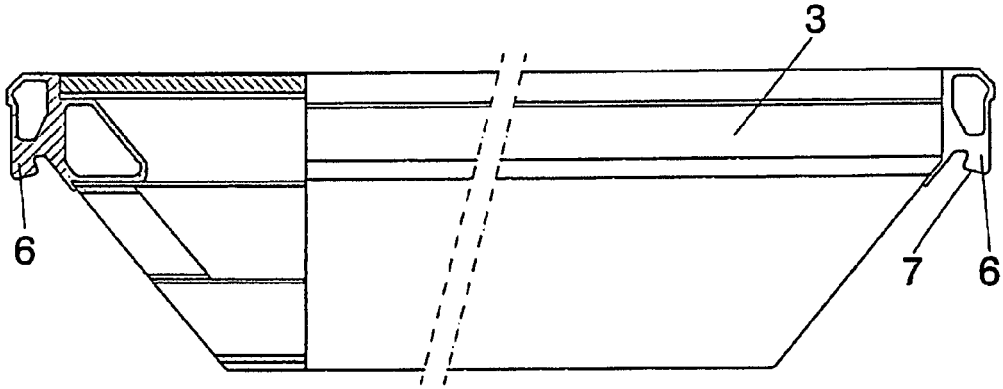
FIGS. 6 and 7 correspond to a longitudinal elevation view and a profile view of a primary beam.

According to the described characteristics, assembly is performed following the stages shown in FIG. 13, so that in a first stage a) a brace (1) is installed with its corresponding support bolster (2), with the former being held with a tripod (42). Then the support bolster (2) is caught by the primary beam (3), which is left hanging from said bolster (2). After this the primary beam (3) is raised with a second brace (1), as shown in the stage c) of FIG. 13, thereby assembling the first primary beam (3) between the bolsters (2) corresponding to the braces (1) shown in the stage c) of FIG. 3, as mentioned before.

After the first beam is placed a second beam can be installed similarly, as shown in stage d) of FIG. 13, where two beams (3) are shown assembled parallel to each other between the corresponding pairs of braces (1).

Next the cross beams (4) are mounted, supported in the same manner as the primary beams (3), that is, with the inclined surface (7) of their end heels (6) resting on the corresponding cradles (18) of the plate (16) of the braces (2).

Assembly can continue in two different ways.

1. —Placing the panels (5) on the beams to complete the grid, mounting the panels from the top, that is, with the worker above the grid, or from the bottom, in which case the panels (5) are hung from the beams (3) and then set in their position. When working at great heights it is more common to work from the top.

2. —Continuing the assembly of the primary and secondary beams (3) and (4) until obtaining the complete grid structure and then placing all the panels, with this being the most common and quickest form as it increases the rate of the assembly, particularly from above, reducing the number of workers required as the person placing the beams from the ground can be the same one as that placing the panels from above.

The cross beams (4), which as the others are made from an aluminum profile, are not only used to close the grid as mentioned before, providing the exact distance between the primary beams (3), but also stiffen the assembly even before the panels (5) are placed, as well as constituting sealing elements by their upper and lateral coating provided by the part or bar made of a plastic material or rubber (12) with which said cross beams (4) are provided. Likewise, because of the configuration of the part or profile (12) placed above and defined by an extruded profile, said cross beams will absorb any clearances between the panels (5), pressing them together to close any gaps and preventing the concrete slur from escaping.

Figure 25A:
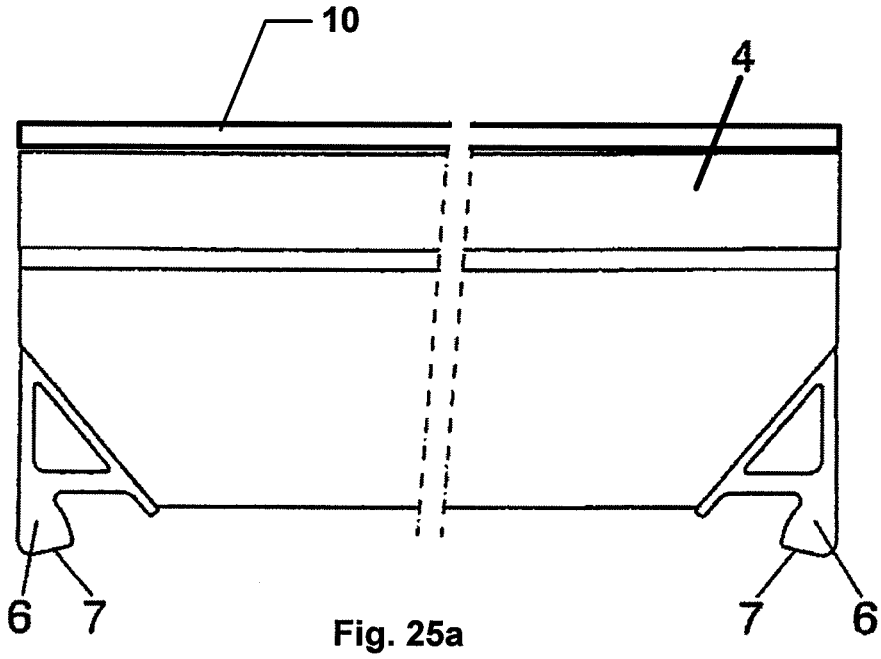
FIGS. 25*a* and 25*b* illustrate a primary and secondary beam with a wood block.
Figure 25B:
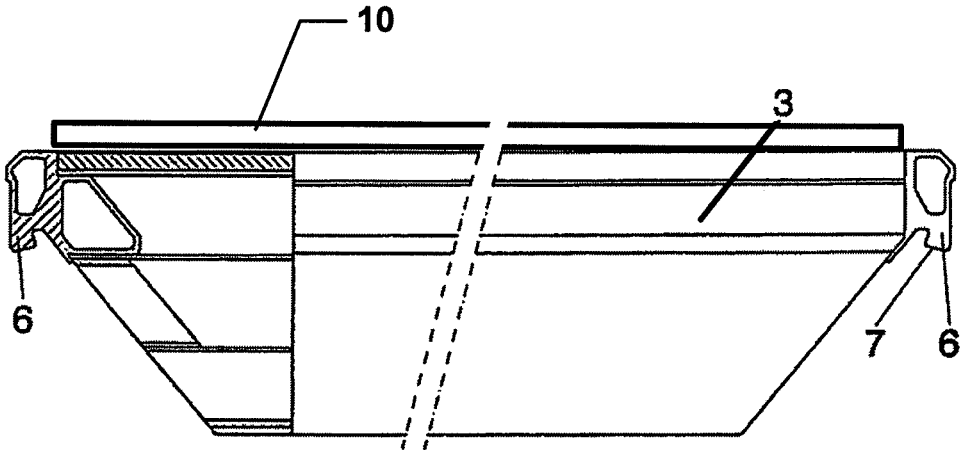

FIGS. 25*a* and 25*b* illustrate a primary and secondary beam with a wood block 10 on top thereof.

The structure described for the primary beams (3) allows mounting transversally on the grooves (8) provided on their sides further longitudinal beams (3) to provide an outlet at 90° that changes the direction of assembly of the grid or even allows overhangs to be established, with support on said grooves (8) being provided by the heels (6) established on the end of said longitudinal beams (3) set at 90°.

Figure 7:
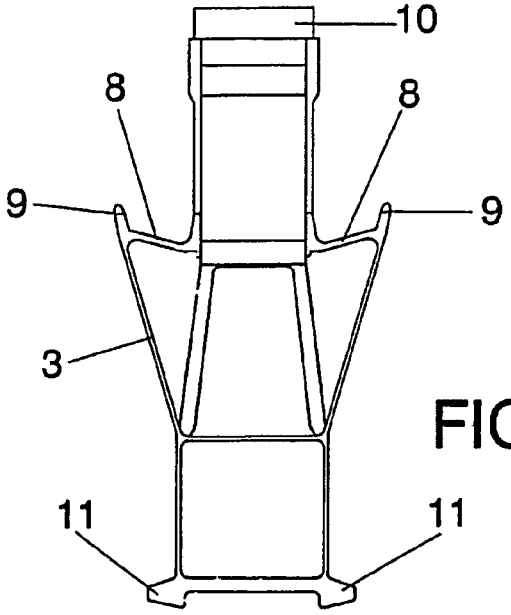
Figure 8:
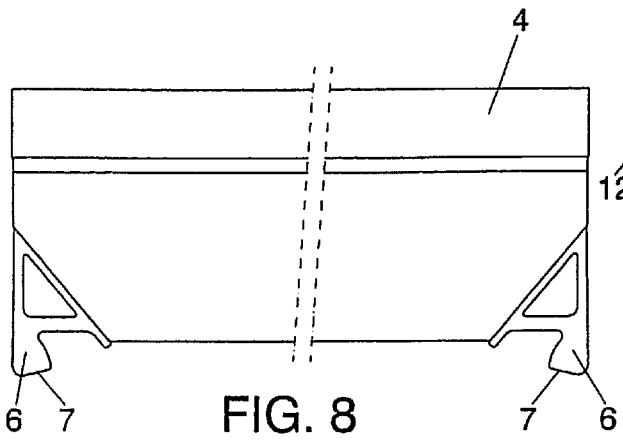
FIGS. 8 and 9 also show a longitudinal elevation view and a profile view of a cross beam.

Finally, as shown in FIG. 7, the primary beams (3) have lower protrusions (11) in the form of heels, between which is defined a recess that forms a housing, with said heels (11) having an inclined surface so that the aforementioned primary beams (3) can rest through the inclined surfaces on fixed bolsters, with the aforementioned recess used to house means or components for centering the beam on the bolster.

The invention claimed is:

1. A slab formwork system comprising:

a plurality of primary beams;

a plurality of cross-beams for connecting to a respective two of the plurality of primary beams and spacing the respective two of the plurality the primary beams apart;

a plurality of vertical braces;

a plurality of support bolsters, each of the support bolsters mounted on top of a respective one of the plurality of vertical braces for supporting at least one end of a respective one of the plurality of primary beams and one of a respective cross-beam, at least one formwork panel supported by one of the plurality of primary beams, the formwork panel comprising inner partitions for providing support;

wherein each of the support bolsters comprises a plate, each plate comprising four sectors forming a cross shape, each sector defining one of a plurality of cradles, each cradle comprising a first inclined planar base having a projection extending upwardly therefrom for the positioning and support at least one end of one of a respective one of the plurality of primary beams and one of a respective cross-beam, wherein the at least one end of the respective one of the plurality of primary beams and one of the respective cross-beam supported by the support bolster comprises a heel having a lower surface comprising a first inclination complementarily to the first inclined planar base of the respective one of cradles for wedging the at least one formwork panel towards the respective one of the vertical braces.

2. The slab formwork system of claim 1, wherein each of the plurality of primary beams comprises a longitudinal extension comprising a beam groove having a second inclined base and a front protrusion, the second inclined base being similar to the first inclined base.

3. The slab formwork of claim 2, wherein the beam groove receives one of at least one formwork panels and a secondary beam, the secondary beam for riveting against one of a structure column and a wall.

4. The slab formwork of claim 2, wherein the at least one formwork panel comprises a lower protrusion having a lower surface, the lower surface comprising a second inclination complementarily to the second inclined base for being received by the beam groove for supporting the at least one formwork panel.

5. The slab formwork system of claim 2, wherein the beam groove receives one of the plurality of cross-beams.

6. The slab formwork system of claim 1, wherein one of the plurality of cross-beams comprises a cover, the cover comprising an extruded profile of rubber forming a seal between adjacent formwork panels and providing a means for absorbing possible clearances between the formwork panels caused during their assembly.

7. The slab formwork system of claim 1, wherein each cradle comprises partitions for stiffening the plate and guiding the at least one end of one of a respective one of the plurality of primary beams and one of a respective cross-beam.

8. The slab formwork system of claim 7, wherein each projection is in the form of an outwardly projecting oblique protrusion for hanging one of the plurality of primary beams or one of the cross-beams from a respective one of a plurality of bolster supports when raising and assembling the slab formwork system.

9. The slab formwork system of claim 1 further comprising an external nut as a locking wedge for supporting the plate, the external nut being manually turned for locking and retaining the plate in a raised position and turned for unlocking the plate to descend for the corresponding stripping of one of the plurality of primary beam and plurality of cross-beams and formwork panels.

10. The slab formwork system of claim 9, wherein one of a plurality bolster supports comprises a main tube having a stopping element, and the nut comprises a pair of inclined planes which one of lock and unlock against the stopping element.

11. The slab formwork comprises of claim 9, wherein the nut comprises a lateral protrusion for striking by a hammer to lock and unlock the nut.

12. The slab formwork system of claim 9, wherein one of a plurality of bolster supports comprises a main tube for sliding the plate and the nut and a tubular lower segment for coupling to a top end of the respective vertical brace, wherein the top end of the respective vertical brace comprises a locking device for locking the respective vertical brace to the respective bolster support.

13. The slab formwork system of claim 1 further comprising a wooden block disposed on one of the plurality of primary beams or one of the plurality of cross-beams for nailing wooden boards to the beams.

14. The slab formwork system of claim 1, wherein the at least one formwork panel comprises a frame, the frame comprises a reinforcement bracket mounted on a corner of the frame and are mounted with a guide on a profile of the frame.

15. The slab formwork system of claim 1, wherein the at least one formwork panel comprises a peripheral frame with a stiffening bracket, a small intermediate step for resting a transverse rib of the at least on formwork panel panels, a protrusion comprising a third lateral inclined surface for simplifying insertion of a last formwork panel of a grid, ending at an edge on its bottom to define an anti-drip element in the event that concrete filters between the panels; with the frame that forms the formwork panel being inferiorly provided with a bevelling that allows to hang a corresponding formwork panel vertically during a stripping operation.

16. A slab formwork system of claim 1, wherein one of the plurality of primary beams comprises lower protrusions in the form of heels between which is defined a recess that establishes a housing, the heels having an third inclined base so that the aforementioned primary beam can rest by said inclined surfaces on fixed bolsters, with the aforementioned recess used to house means for centering the beam on the bolster.

17. A slab formwork system comprising:

a support grid comprising a plurality of primary beams, a plurality of cross-beams, and a formwork panel;

a plurality of vertical braces, each vertical brace comprising one of a plurality of support bolsters, each of the support bolsters supporting one end of the plurality of primary beams and one end of one of the plurality of cross-beams;

wherein each of the support bolsters comprise a cradle having an inclined planar receiving base having a projection extending upwardly therefrom;

wherein each of the one end of the plurality of primary beams and one end of one of the plurality of cross-beams supported by the respective support bolster comprises a heel having a first lower surface that is inclined complementarily to the receiving base of the respective one of cradles for wedging the one formwork panel towards the respective one of the vertical braces.

18. A slab formwork system comprising:

a plurality of primary beams;

a plurality of cross-beams for connecting to a respective two of the plurality of primary beams and spacing the respective two of the plurality the primary beams apart;

a plurality of vertical braces;

a plurality of support bolsters, each of the support bolsters mounted on top of a respective one of the plurality of vertical braces for supporting at least one end of a respective one of the plurality of primary beams and one of a respective cross-beam, at least one formwork panel supported by one of the plurality of primary beams, the formwork panel comprising inner partitions for providing support;

wherein each of the support bolsters comprises a plate, each plate comprising four sectors (18), forming a cross shape, each sector defining one of a plurality of cradles, each cradle comprising a first inclined base for the positioning and support at least one end of one of a respective one of the plurality of primary beams and one of a respective cross-beam, wherein the at least one end of the respective one of the plurality of primary beams and one of the respective cross-beam supported by the support bolster comprises a heel having a lower surface comprising a first inclination complementarily to the first inclined base of the respective one of cradles for wedging the at least one formwork panel towards the respective one of the vertical braces;

an external nut as a locking wedge for supporting the plate, the external nut being manually turned for locking and retaining the plate in a raised position and turned for unlocking the plate to descend for the corresponding stripping of one of the plurality of primary beam and plurality of cross-beams and formwork panels wherein one of a plurality of bolster supports comprises a main tube for sliding the plate and the nut and a tubular lower segment for coupling to a top end of the respective vertical brace, wherein the top end of the respective vertical brace comprises a locking device for locking the respective vertical brace to the respective bolster support, wherein the locking device comprises a spring and a bolt biased by the spring, the respective vertical brace comprising a first orifice and the main tube comprising a second orifice;

wherein the bolt comprising a first and second bolt protrusion respectively extending through the first and second orifices;

wherein the second bolt protrusion for releasing the bolt when hit and separating the respective bolster support and vertical brace.

* * * * *